US005774776A

United States Patent [19]

Takada et al.

[11] Patent Number: 5,774,776

[45] Date of Patent: Jun. 30, 1998

[54] HEATER AND IMAGE HEATING DEVICE

[75] Inventors: Shigeaki Takada, Tokyo; Hisaaki Senba, deceased, late of Yokohama, both of Japan, by Reiko Senba, Legal Representative

[73] Assignee: Canon Kabushiki Kaisha, Tokyo, Japan

[21] Appl. No.: 885,811

[22] Filed: Jun. 30, 1997

Related U.S. Application Data

[63] Continuation of Ser. No. 701,791, Aug. 26, 1996, abandoned.

[30] Foreign Application Priority Data

Aug. 30, 1995 [JP] Japan ..... 7-222114

[51] Int. Cl.[6] ..... G03G 15/20

[52] U.S. Cl. ..... 399/328; 219/216; 399/329

[58] Field of Search ..... 399/329, 328, 399/335; 432/56; 219/216, 542, 543, 548, 549, 552

[56] References Cited

U.S. PATENT DOCUMENTS 5,171,969 12/1992 Nishimura et al. .
5,204,723 4/1993 Hanada et al. .
5,376,773 12/1994 Masuda et al. ..... 219/543
5,499,087 3/1996 Hiraoka et al. ..... 399/329
5,512,993 4/1996 Endo et al. .
5,587,097 12/1996 Sato et al. ..... 219/216 X

FOREIGN PATENT DOCUMENTS 63-313182 12/1988 Japan .
2-157886 6/1990 Japan .
8-241003 9/1996 Japan .

*Primary Examiner*—Matthew S. Smith
*Attorney, Agent, or Firm*—Fitzpatrick, Cella, Harper & Scinto

[57] ABSTRACT

There is disclosed an image heating device including a heater in which a heat generating element and electrodes to supply a current to the heat generating element are provided on a longitudinal substrate, a film adapted to be slid with the heater, and a back-up member for form a nip together with the through the film. A recording member bearing an image is pinched and conveyed and the image is heated by a heat from the heater through the film in the nip. The heater has a mark in at least an edge portion in the longitudinal direction.

21 Claims, 5 Drawing Sheets

HEATER AND IMAGE HEATING DEVICE

This application is a continuation of application Ser. No. 08/701,791, filed Aug. 26, 1996, now abandoned.

BACKGROUND OF THE INVENTION

1. Field of the Invention

The invention relates to an image heating device using a film heating system such that a recording member is come into pressure contact with a heating element through a film and a heat energy is given to the recording member from the heating element through the film and also relates to a heater for such a device.

2. Related Background Art

A fixing device of the film heating system can use a line-shaped heating element of a low heat capacitance, so that a low electric power consumption and a reduction of a waiting time (quick start performance) can be realized, as compared with the thermal fixing type device using any one of the other well-known heat roller system, heat plate system, belt fixing system, flash fixing system, oven fixing system, and the like. Further, since a fixing point and a separating point can be independently set, there is an advantage such that an offset can be also prevented. In addition, the fixing device of the film heating system has advantages such that it can solve various drawbacks of the apparatuses using the other systems and the like, so that it is effective.

The applicant of the present invention has already proposed the fixing device using such a film heating system (for example, refer to Japanese Patent Application Laid-Open No. 63-313182). The fixing device is provided with a thin fixing film (sheet) having a high heat resistance, moving driving means of the fixing film, a heating element arranged so as to be fixedly supported to one surface side of the fixing film while setting the fixing film to the inside, and a pressurizing member arranged on the other surface side so as to face the heating element, wherein a development image holding surface of the recording member on which an image should be fixed is adhered closely to the heating element through the fixing film by the pressurizing member.

In such a fixing device, at least upon fixing of an image, the fixing film is run and moved in the forward direction at the same speed as that of the recording member that is conveyed and guided into a gap between the fixing film and the pressurizing member. The recording member passes through a fixing nipping portion which is formed with a pressure contact by the heating element and the pressurizing member, interposing the fixing film run and moved between there, so that the development image holding surface of the recording member is heated by the heating element through the fixing film. A heat energy is applied to a development image (unfixed toner image), so that the development image is softened and fused, thus fixed onto the recording member.

In the fixing device using the film heating system as mentioned above, generally the heating element is constructed by a heat resistant substrate, a heat generating element formed thereon by a screen print, and electrodes. The heat generating element is arranged in a width region of the nipping portion so as to correspond to each other, and has a structure such that a width in the minor side direction is set to be equal to or less than the width of fixing nip and only a portion in the nipping portion is concentrically heated.

In the conventional fixing device, however, when an amount of heat to be applied in order to raise a fixing performance is increased, the toner on the recording member is excessively fused, and the toner keeps a high viscosity until the recording member and the fixing film are released from each other, so that a part of the toner is deposited onto the fixing film. Thus, when the portion of the fixing film on which the toner is deposited subsequently comes to the nipping portion, the deposited toner is fixed onto the recording member, so that there is a problem such that a phenomenon called a high temperature offset which deteriorates the image occurs.

By raising a processing speed, simultaneously with that the recording member bearing the unfixed toner image enters the nipping portion, it is suddenly heated and the moisture contained in the recording member becomes a steam and is blown out from the nipping portion to the conveying entrance direction side. Therefore, there is a case where a phenomenon called a fixing fly-off such that the unfixed toner image is flown off occurs.

A technique to provide a structure of the fixing device of the film heating system such that the above phenomenon does not occur was examined, so that it has been found that the position in the minor side direction of the heat generating element in the nipping portion intimately affects it. This is because a temperature distribution of the nipping portion and its peripheral portions changes depending on the position of the heat generating element. That is, as the heat generating element is arranged near the conveying entrance direction side, a temperature on the conveying entrance direction side rises, the recording member is heated before it enters the nipping portion, and the fixing fly-off can be reduced. On the other hand, the temperature on a conveying exit direction side decreases, the toner image is cooled and solidified when the fixing film and the recording member are released from each other, so that the high temperature offset can be also reduced.

However, if the heat generating element protrudes from the nipping portion since the heat generating element is too close to the conveying direction entrance side, a difference between the heat generation amount of the heat generating element and the heat amount used for fixing is increased, and the heating element is overheated due to the heat amount corresponding to such a difference. Thus, when the heating element and heat generating element have low head capacitances, a breakage occurs in the heat generating element and the life of the heating element is lowered. If the heat capacitances of the heating element and heat generating element are raised, therefore, it is disadvantageous for the low electric power consumption and the reduction of the waiting time as features of the film heating system.

For this reason, it is necessary to extremely strictly adjust the position of the heat generating element in order to raise the processing speed (realization of a high processing speed) and a fixing performance.

However, since the heat generating element exists within the nipping portion and cannot be seen from the outside, it is impossible to adjust the position of the heat generating element while observing the position thereof. It is, thus, difficult to strictly adjust the position of the heat generating element in the nipping portion.

SUMMARY OF THE INVENTION

It is an object of the invention to provide an image heating device which can prevent the occurrence of a high temperature offset, a fixing fly-off, or the like and also to provide a heater for such a device.

Another object of the invention is to provide an image heating device for enabling the position of a heater to be easily adjusted and also to provide a heater for such a device.

Still another object of the invention is to provide an image heating device in which a heater has marks in at least end portions in the longitudinal direction and also to provide a heater for such a device.

The above and other objects and features of the present invention will become apparent from the following detailed description and the appended claims with reference to the accompanying drawings.

DETAILED DESCRIPTION OF THE PREFERRED EMBODIMENTS

Embodiments of the present invention will now be described hereinbelow with reference to the drawings.

<First Embodiment>

Figure 1:
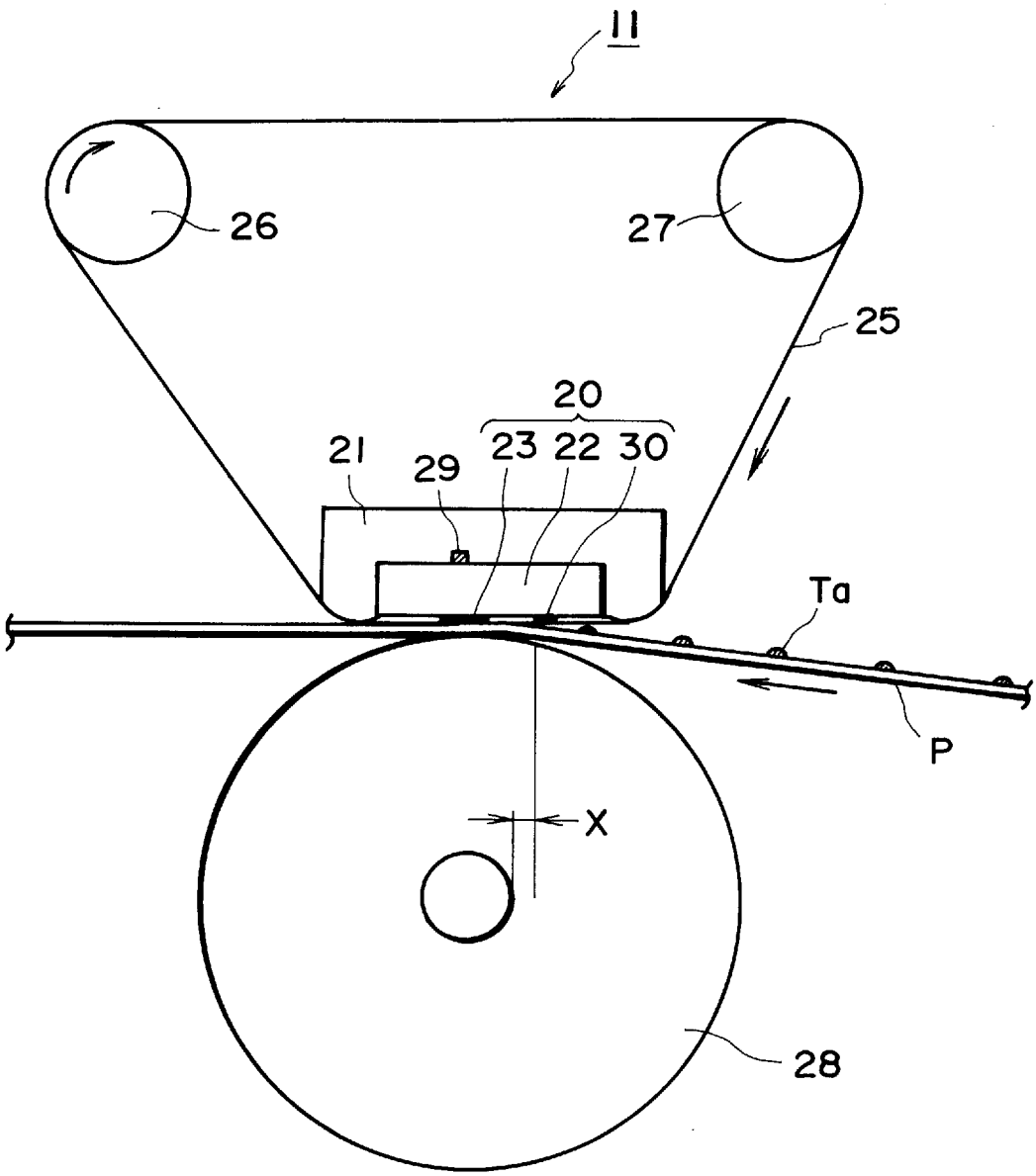
FIG. 1 is a cross sectional view showing a schematic construction of a fixing device according to the invention.

FIG. 1 is a cross sectional view showing a schematic construction of a fixing device 11 as an image heating device using a film heating system according to the invention. In the drawing, reference numeral 25 denotes an endless belt-shaped fixing film. The fixing film 25 is wound and suspended among a driving roller 26 on the left side, a driven roller 27 on the right side, and a line-shaped heating element 20 of a low heat capacitance serving as a heating element (heater) arranged under a portion between the rollers 26 and 27.

The driven roller 27 also functions as a tension roller of the fixing film 25. The fixing film 25 is rotated without a wrinkle, a zigzag motion, and a speed delay at a predetermined peripheral speed [namely, the same peripheral speed as the conveying speed of a transfer material sheet P as a recording member on which an unfixed toner image Ta that is conveyed from an image forming portion side (not shown) has been beared on the upper surface] in the direction shown by an arrow in FIG. 1 in association with the rotation of the driving roller 26 in the direction shown by an arrow in FIG. 1.

Reference numeral 28 denotes a pressurizing roller as a pressurizing member (back-up member). The pressurizing roller 28 has a rubber elastic layer such as a silicon rubber or the like having a good releasability and is come into pressure contact with the lower surface of the line-shaped heating element 20 by biasing means (not shown) with a total contact pressure within a range from 4 to 7 kg and is rotated counterclockwise of the forward direction in the conveying direction of the transfer material sheet P.

Since the fixing film 25 is repetitively used for heating and fixing a toner image, the film 25 has excellent heat resistance, releasability, and durability. Generally, a thin film having a total thickness of 100 $\mu$m or less, preferably, 40 $\mu$m or less is used. Specifically, for example, a single layer film having a thickness of 20 $\mu$m of a heat resistant resin such as polyimide, polyether imide, PES, PFA (tetrafluoroethylene-perfluoroalkyl vinyl ether copolymer resin), or the like is used, or a film is also used in which a releasability coating layer having a thickness of 10 $\mu$m obtained by adding a conductive material into a fluororesin such as PTFE (tetrafluoroethylene resin), PAF, or the like is coated to at least the image contact surface side of a compound layer film.

The line-shaped heating element 20 serving as a heating element is constructed by a laterally long heater substrate 22 in which the transversing direction of the fixing film 25 is set to a longitudinal side, a heat generating element 23 formed along the lower surface longitudinal direction on the lower side of the heater substrate 22, electrodes 31 (refer to FIG. 2) for supplying an electric power to the heat generating element 23 from both end portions thereof, a mark 30 for adjusting the position of the heat generating element 23 and serving as printing regions to which no current is supplied, and an overcoating layer for protecting the heat generating element 23. The heating element 20 is attached to and held by a heater supporting base 21 having high rigidity and heat resistance. The heater supporting base 21 is constructed by a high heat resistance resin such as PPS (polyphenylene sulfite), PAI (polyamideimide), PI (polyimide), PEEK (polyether ether ketone), liquid crystal polymer, or the like, a composite material of such a resin and a ceramics metal, glass, etc., or the like.

A temperature sensing element 29 for detecting a temperature of the heating element 20 is provided on the upper surface side (surface opposed to the surface that is in contact with the fixing film 25) of the heater substrate 22.

A construction of the heating element 20 and its function will now be described in detail.

Figure 2:
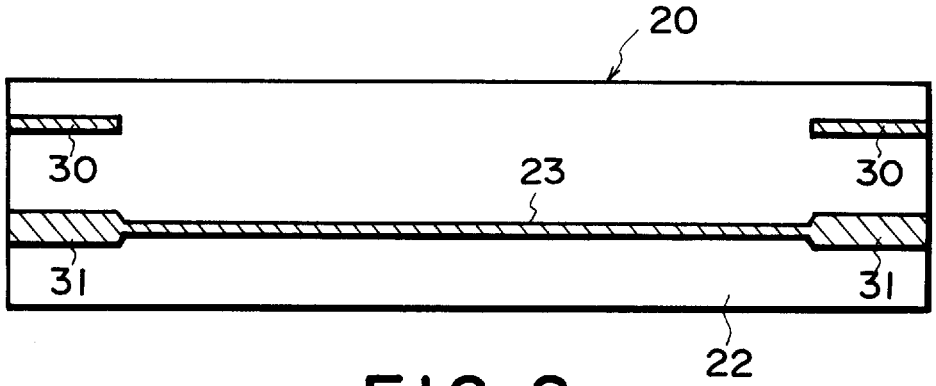
FIG. 2 is a bottom view of a heating element according to a first embodiment of the invention.

FIG. 2 is a bottom view of the heating element 20 (diagram when the heating element 20 in FIG. 1 is seen from the bottom). As shown in the drawing, the electrodes 31 are formed in both end portions of the heat generating element 23. The electrodes 31 are formed by coating a material such as Ag, Cu, or the like having a high conductivity onto the heater substrate 22 by a screen-printing method.

Figure 3:
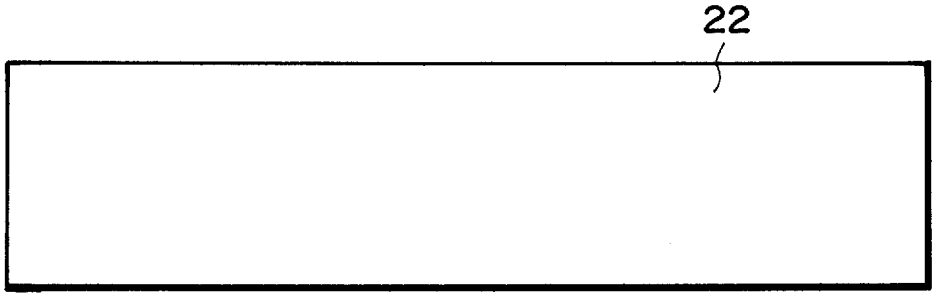
FIG. 3 is a plan view of a heater substrate according to the first embodiment of the invention.

The heater substrate 22 shown in FIG. 3 is formed by a good heat conductor of alumina, aluminum nitride, or the like having a thickness of 1.0 mm, a width of 10 mm, and a length of 240 mm.

Figure 4:
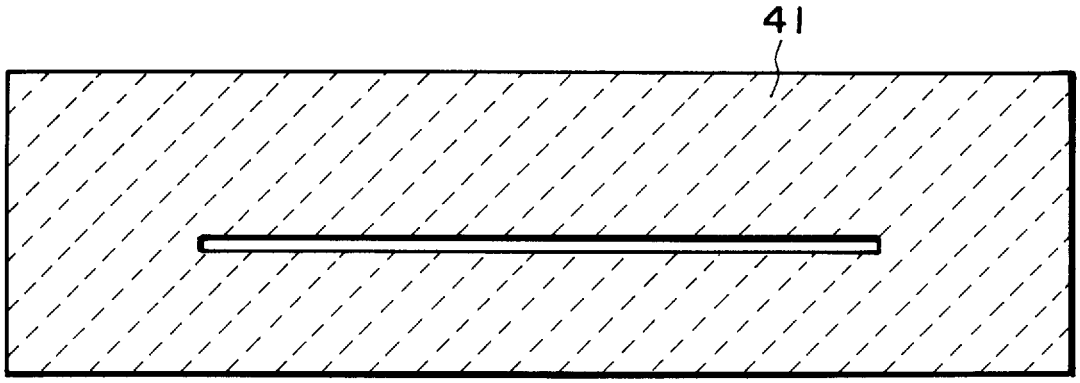
FIG. 4 is a plan view of a screen for printing a heat generating element according to the first embodiment of the invention.
Figure 5:
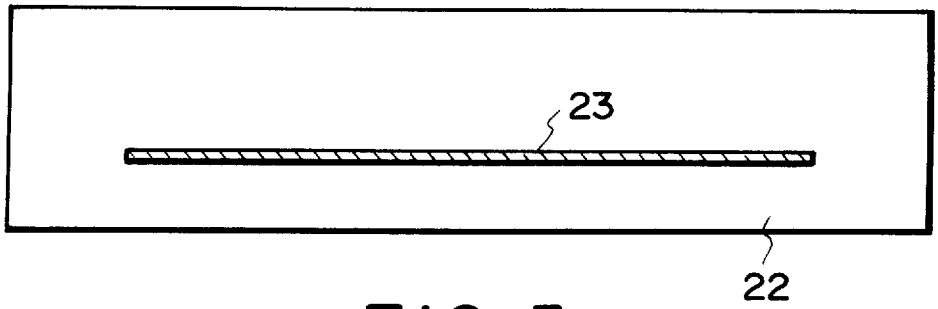
FIG. 5 is a plan view showing a state in which the heat generating element has been printed on the heater substrate according to the first embodiment.

The heat generating element 23 is formed by screen-printing an electric resistance material such as Ag/Pd, $RuO_2$, $Ta_2N$, or the like having a width of 2.5 mm along the lower surface longitudinal direction of the heater substrate 22. That is, the heat generating element 23 is screen-printed onto the heater substrate 22 as shown in FIG. 5 by a screen 41 shown in FIG. 4.

Figure 6:
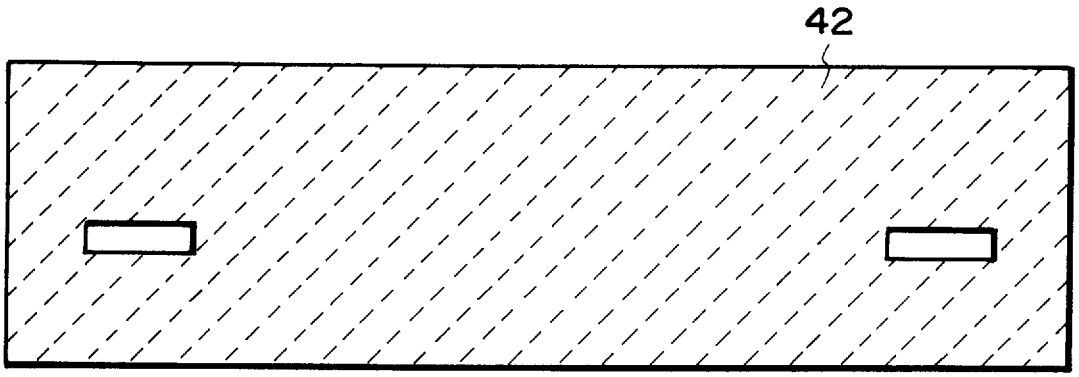
FIG. 6 is a plan view of a screen for printing electrodes according to the first embodiment of the invention.
Figure 7:
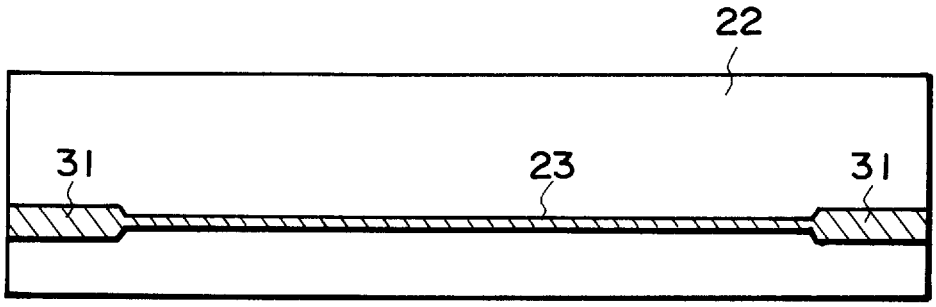
FIG. 7 is a plan view showing a state in which the heat generating element and the electrodes have been printed on the heater substrate according to the first embodiment of the invention.

The electrodes 31 are also screen-printed onto the heater substrate 22 by a screen 42 as shown in FIG. 6 in a manner similar to the heat generating element 23. FIG. 7 shows a state in which the electrodes 31 have been printed by the screen 42 onto the heater substrate 22 on which the heat generating element 23 had previously been screen-printed.

Figure 8:
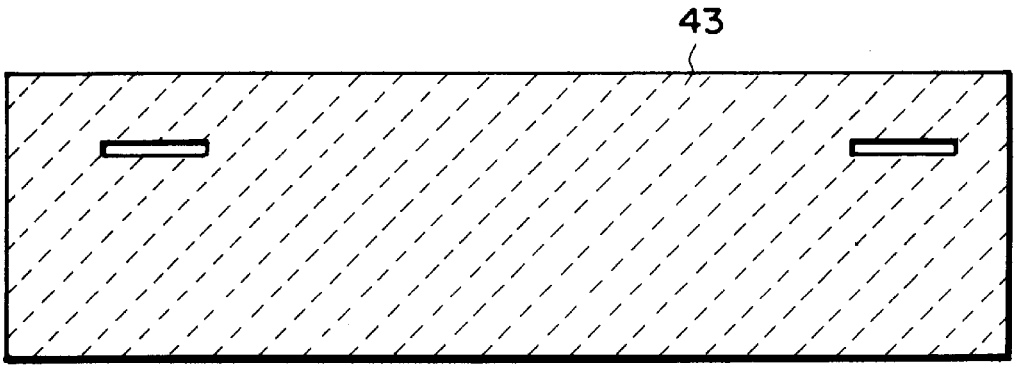
FIG. 8 is a plan view of a screen for marks according to the first embodiment of the invention.

Further, the marks 30 for adjusting the position of the heat generating element 23 are formed by screen-printing to both end portions of the lower surface of the heater substrate 22 by a screen 43 shown in FIG. 8. As a material of the marks 30, it is sufficient to use a material having a high heat resistance and it is desirable to use a material that can be easily observed with the eyes. The position and size of the marks 30 are also not particularly limited so long as they are convenient when adjusting the position of the heat generating element 23. The marks 30 are formed at positions which are away from the heat generating element 23 by only a predetermined distance in the minor side direction of the heater substrate 22.

As mentioned above, by screen-printing the heat generating element 23, electrodes 31, and marks 30 onto the heater substrate 22 by using three screens 41, 42, and 43, respectively, the line-shaped heating element 20 shown in FIG. 2 is manufactured.

Figure 9:
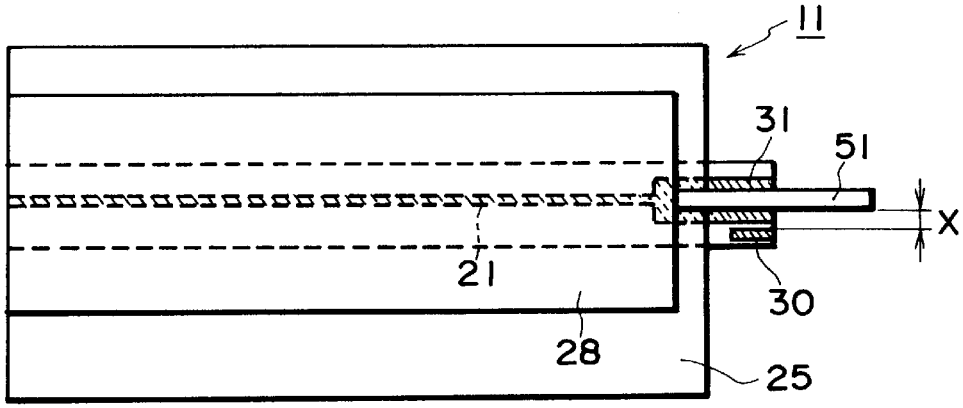
FIG. 9 is a bottom view of a fixing device according to the first embodiment of the invention.

FIG. 9 is a diagram when the fixing device 11 shown in FIG. 1 is seen from the side just under the pressurizing roller 28. The position and width of the nip can be almost accurately grasped from the shape on the lower surface side of the heating element 20, position of an axis 51 of the pressurizing roller 28, and hardness, shape, and pressure of the pressurizing roller 28, and hence by adjusting an interval X between the shaft 51 of the pressurizing roller 28 and the mark 30, the position of the heat generating element 23 in the nip which was difficult to be adjusted because it could not been seen from the outside, can be easily and accurately adjusted. The occurrence of the high temperature offset, fixing fly-off, or the like can also be suppressed.

<Second Embodiment>

The second embodiment of the invention will now be described.

The embodiment is characterized in that when the heating element 20 similar to that in the first embodiment is manufactured, the heat generating element 23 and marks 30 are screen-printed by using the same screen.

Figure 10:
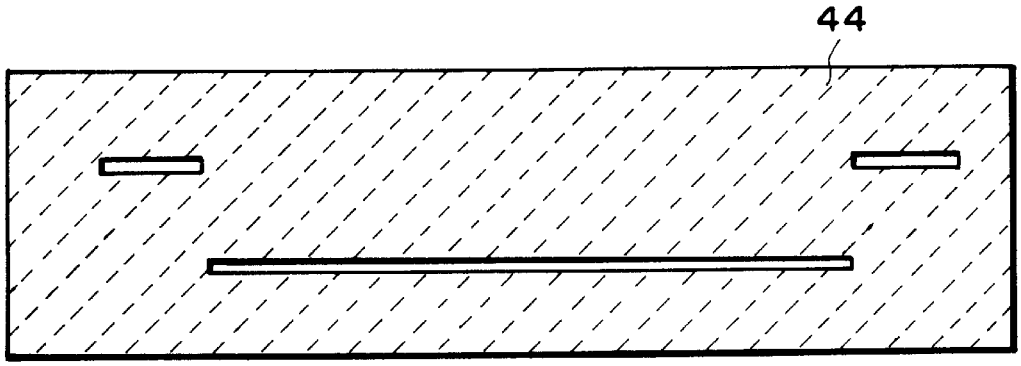
FIG. 10 is a plan view of a heat generating element and a screen for marks according to a second embodiment of the invention.

The heat generating element 23 and marks 30 for adjusting the position of the heat generating element are screen-printed onto the heater substrate 22 as shown in FIG. 3 by using a screen 44 shown in FIG. 10. A trimming position corresponding to the heat generating element 23 and marks 30 of the screen 44 is away from each other in the minor side direction by a predetermined distance. In this instance, since the heat generating element 23 and marks 30 are formed by different materials, it is necessary to perform a masking or the like so as not to mix those materials.

Figure 11:
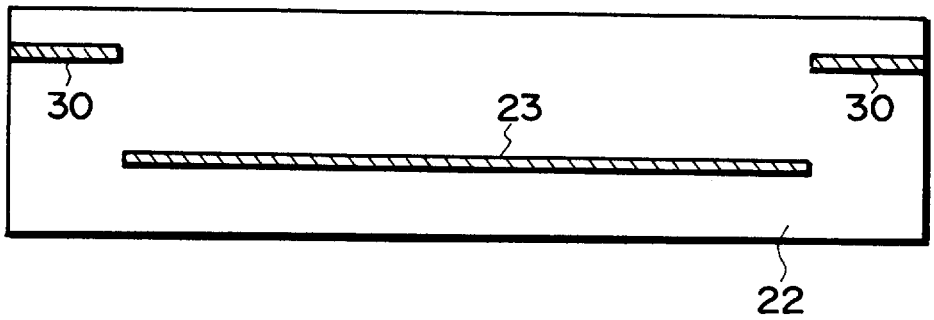
FIG. 11 is a plan view showing a state in which the heat generating element and the marks have been printed on a heater substrate according to the second embodiment of the invention.

FIG. 11 shows a state in which the heat generating element 23 and marks 30 have been printed onto the heater substrate 22 by the screen 44. By screen-printing the electrodes 31 with the screen 42 shown in FIG. 6, the heating element 20 similar to that in FIG. 2 is obtained.

As mentioned above, by screen-printing the heat generating element 23 and marks 30 for adjusting the position of the heat generating element by using the same screen 44, the positional relation between the heat generating element 23 and the marks 30 is not deviated. Therefore, the heating element 20 in which the marks 30 for adjusting the position are located at the extremely accurate positions for the heat generating element 23 can be manufactured. By adjusting the positions of the marks 30 and the position of the pressurizing roller 28 with respect to the moving direction of the recording member, the position of the heat generating element 23 in the nip can be easily and accurately adjusted.

<Third Embodiment>

The third embodiment of the invention will now be described.

The embodiment is characterized in that the heat generating element 23 and marks 30 are simultaneously screen-printed by using the same material and same screen.

Figure 12:
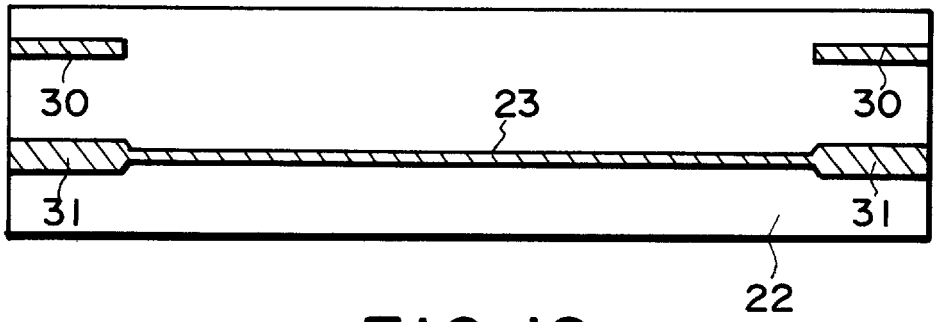
FIG. 12 is a bottom view of a heating element according to a third embodiment of the invention.

Since the same material is used for the heat generating element 23 and marks 30, the heat generating element 23 and marks 30 can be simultaneously screen-printed onto the heater substrate 22 by using the screen 44 shown in FIG. 10. FIG. 12 shows a bottom view of the heating element 20 obtained in this manner.

By screen-printing the electrodes 31 with the screen 42 shown in FIG. 6, the heating element 20 shown in FIG. 12 is obtained.

According to the embodiment, therefore, not only the heating element 20 can be manufactured at a high precision without deviating the positional relation between the heat generating element 23 and marks 30, but also the number of manufacturing steps is reduced as compared with the case of using the different material for the marks 30, so that the heating element 20 can be easily manufactured.

<Fourth Embodiment>

The fourth embodiment of the invention will now be described.

Figure 13:
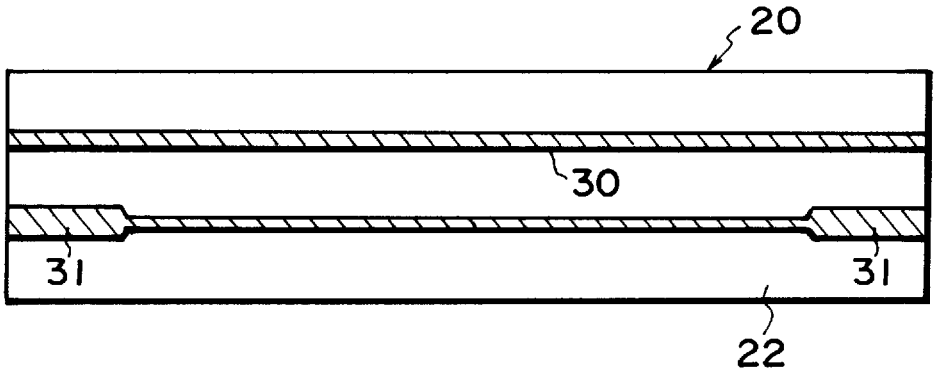
FIG. 13 is a plan view showing a state in which a heat generating element and marks have been printed on a heater substrate according to a fourth embodiment of the invention.

FIG. 13 is a bottom view of the heating element 20. As shown in the drawing, the marks 30 for adjusting the position of the heat generating element 23 are screen-printed by the same material as the heat generating element 23 in the longitudinal direction of the heater substrate 22 in parallel with the heat generating element 23 with the same screen as that of the heat generating element 23. The marks 30 are arranged so as to be located on the recording member entering side (upstream side than the heat generating element 23 with respect to the moving direction of the recording member) than the nipping portion with the pressurizing roller 28 (refer to FIG. 1).

Since the marks 30 are formed by the same material such as Ag, Pd, or the like having a high heat conductivity as that of the heat generating element 23, the marks absorb the heat generated by the heat generating element 23 more efficiently than the other portions, so that a temperature rises. By arranging the marks 30 to positions in front of the nipping portion, a heat is effectively given to the recording member before the unfixed toner image enters the nipping portion. Thus, a viscosity of the toner of the unfixed toner image is raised and it is prevented that the vapor is explosively generated from the recording member, so that the occurrence of the fixing fly-off can be suppressed.

Since the marks 30 absorb the ambient heat and its temperature rises, even if the marks are arranged out of the nipping portion, a situation such that the marks are overheated and the life of the heating element 20 deteriorates does not occur.

As mentioned above, the marks 30 are used not only for adjusting the position of the heat generating element 23 but also for preventing the occurrence of the fixing fly-off by preheating the recording member.

Although the preferred embodiments have been described above, the present invention is not limited to the foregoing embodiments but many modifications and variations are possible within the spirit and scope of the appended claims of the invention.

What is claimed is:

1. An image heating device comprising:

a heater in which a heat generating element and electrodes for supplying electric power to said heat generating element are provided on a longitudinal substrate;

a film adapted to be slid on said heater; and a back-up member for forming a nip together with said heater through said film, wherein a recording member bearing an image is pinched and conveyed and the image is heated by heat from said heater through said film in said nip, and said heater has a mark in at least an end portion in the longitudinal direction of said substrate, wherein each of said heat generating element and said mark is formed of the same material.

2. A device according to claim 1, wherein said mark is a mark for adjusting a position of said heat generating element relative to said back-up member.

3. A device according to claim 2, wherein said position adjustment is a position adjustment in a moving direction of said recording member.

4. A device according to claim 1, wherein said mark is provided at a position which is separated from said heat generating element by a predetermined distance with respect to the moving direction of said recording member.

5. A device according to claim 1, wherein said heat generating element and said mark is formed by screen-printing by using a single screen.

6. A device according to claim 1, wherein said same material is Ag/Pd.

7. A device according to claim 1, wherein said mark are provided over the longitudinal direction of said substrate.

8. A device according to claim 7, wherein said mark is provided on an upstream side of said heat generating element with respect to the moving direction of said recording member.

9. A device according to claim 8, wherein said mark is made of a material of high heat conductivity.

10. A device according to claim 1, wherein said longitudinal direction of said heater is a direction perpendicular to the moving direction of said recording member.

11. A device according to claim 10, wherein said heat generating element is provided along the longitudinal direction of said substrate.

12. A device according to claim 1, wherein said back-up member is a pressurizing roller.

13. A device according to claim 1, wherein an unfixed toner image is fixed onto the recording member at said nip.

14. A device according to claim 1, wherein no current is supplied to said mark.

15. A heater for heating an image, comprising:

a longitudinal substrate;

a heat generating element provided on said substrate;

electrodes for supplying electric power to said heat generating element; and a mark formed in at least an end portion in the longitudinal direction of said substrate, wherein each of said heat generating element and said mark are formed of the same material.

16. A heater according to claim 15, wherein said mark is a mark for adjusting a position of said heat generating element.

17. A heater according to claim 15, wherein said mark is provided at a position which is separated from a predetermined distance from said heat generating element.

18. A heater according to claim 15, wherein said heat generating element and said mark are formed by screen-printing by using a single screen.

19. A heater according to claim 15, wherein said same material is Ag/Pd.

20. A heater according to claim 15, wherein said mark is provided in the longitudinal direction of said substrate.

21. A heater according to claim 15, wherein no current is supplied to said mark.

* * * * *

UNITED STATES PATENT AND TRADEMARK OFFICE

CERTIFICATE OF CORRECTION

PATENT NO. : 5,774,776

DATED : June 30, 1998

INVENTORS : SHIGEAKI TAKADA, ET AL.

It is certified that error appears in the above-identified patent and that said Letters Patent is hereby corrected as shown below:

Item [57] ABSTRACT

Line 5, "form" should read --forming--.

COLUMN 1

Line 9, "is come" should read --comes--.

COLUMN 4

Line 11, "is come" should read --comes--.

COLUMN 7

Line 35, "is" should read --are--; and
Line 39, "are" should read --is--.

UNITED STATES PATENT AND TRADEMARK OFFICE

CERTIFICATE OF CORRECTION

PATENT NO. : 5,774,776

DATED : June 30, 1998

INVENTORS : SHIGEAKI TAKADA, ET AL.

It is certified that error appears in the above-identified patent and that said Letters Patent is hereby corrected as shown below:

COLUMN 8

Line 26, "are" should read --is--; and
Line 31, "from" should read --by--.

Signed and Sealed this

Sixteenth Day of March, 1999

*Attest:*

*Attesting Officer*

Q. TODD DICKINSON

*Acting Commissioner of Patents and Trademarks*